US005740499A

United States Patent [19]

Higeta et al.

[11] Patent Number: 5,740,499

[45] Date of Patent: Apr. 14, 1998

[54] IMAGE FORMING APPARATUS INCLUDING PROCESS CARTRIDGE HAVING ELASTIC SEALING MEMBERS INTERPOSED BETWEEN FRAMES

[75] Inventors: Akira Higeta, Funabashi; Isao Ikemoto, Kawasaki; Nobuharu Hoshi, Yokohama, all of Japan

[73] Assignee: Canon Kabushiki Kaisha, Tokyo, Japan

[21] Appl. No.: 492,528

[22] Filed: Jun. 20, 1995

[30] Foreign Application Priority Data

Jun. 24, 1994 [JP] Japan ..... 6-142909
May 30, 1995 [JP] Japan ..... 7-131804

[51] Int. Cl.[6] ..... G03G 15/08; G03G 21/00

[52] U.S. Cl. ..... 399/105; 399/102; 399/106

[58] Field of Search ..... 399/102, 103, 399/105, 106, 111

[56] References Cited

U.S. PATENT DOCUMENTS

| | | | |
|---|---|---|---|
| 5,208,634 | 5/1993 | Ikemoto et al. | 399/111 |
| 5,331,372 | 7/1994 | Tsuda et al. | 355/200 |
| 5,404,198 | 4/1995 | Noda et al. | 355/200 |
| 5,485,249 | 1/1996 | Higeto et al. | 399/105 |
| 5,561,504 | 10/1996 | Watanabe et al. | 399/103 X |

*Primary Examiner*—Fred L. Braun
*Attorney, Agent, or Firm*—Fitzpatrick, Cella, Harper & Scinto

[57] ABSTRACT

The present invention relates to a process cartridge detachably mountable to a main body of an image forming apparatus, and which has an electrophotographic photosensitive member, a process device actable on the electrophotographic photosensitive member, a first frame, a second frame and an elastic sealing member interposed between the first and second frames in order to prevent leakage of a toner from a space therebetween when the first and second frames are bonded by engagement between engagement portions, wherein the compression amount of the elastic sealing member interposed between both frames is increased away from the engagement portions.

39 Claims, 10 Drawing Sheets

IMAGE FORMING APPARATUS INCLUDING PROCESS CARTRIDGE HAVING ELASTIC SEALING MEMBERS INTERPOSED BETWEEN FRAMES

BACKGROUND OF THE INVENTION

1. Field of the Invention

The present invention relates to a process cartridge and an image forming apparatus to which the process cartridge can detachably be mounted.

Examples of such image forming apparatus include an electrophotographic copying machine, an electrophotographic printer, e.g., a LED printer, a laser beam printer, an electrophotographic facsimile apparatus, an electrophotographic word processor, etc.

Process cartridges include a cartridge comprising charging means, development means or cleaning means and an electrophotographic photosensitive member, which are integrally formed, so that the cartridge is detachably mountable to In another aspect the main body of an image forming apparatus; a cartridge may comprise at least one of charging means, development means and cleaning means and an electrophotographic photosensitive member, which are integrally formed, so that the cartridge is detachably mountable to a main body of an image forming apparatus. Cartridge may comprise at least development means and an electrophotographic photosensitive member, which are integrally formed, so that the cartridge is detachably mountable to a main body of an image forming apparatus.

2. Description of the Related Art

A conventional image forming apparatus which uses an electrophotographic image forming process employs a process cartridge system in which an electrophotographic photosensitive member and process means for acting on the electrophotographic photosensitive member are integrally formed in a cartridge which is detachably mountable to a body of an image forming apparatus. Since this process cartridge system permits a user of the apparatus to maintain the apparatus without the aid of a service man, the operating characteristics can significantly be improved. Thus, the process cartridge system is widely used in image forming apparatus.

On the other hand, in such a process cartridge, an elastic sealing member is interposed between joints of frames in order to prevent leakage of a toner contained in the process cartridge to the outside.

A general sealing method is to deform under compression an elastic material such as Moltplane, soft rubber or elastomer serving as an elastic sealing member, which is held between the junctions.

The present invention has been achieved for further developing the above prior art.

SUMMARY OF THE INVENTION

Accordingly, an object of the present invention is to provide a process cartridge and an image forming apparatus which can prevent leakage of a toner contained in the process cartridge to the outside thereof.

Another object of the present invention is to provide a process cartridge and an image forming apparatus which can prevent leakage of a toner contained in the process cartridge to the outside thereof even if a frame is warped (deformed) due to the reaction force of the elastic sealing member.

A further object of the present invention is to provide a process cartridge and an image forming apparatus in which the deformation amount of an elastic sealing member interposed between first and second frames is increased away from engagement portions therebetween when the first and second frames are engaged and combined by the engagement portions.

DETAILED DESCRIPTION OF THE PREFERRED EMBODIMENTS

A process cartridge and an electrophotographic image forming apparatus to which the process cartridge can detachably be mounted in accordance with embodiments of the present invention are described in detail below with reference to the drawings.

[First Embodiment]

The entire construction of an image forming apparatus to which a process cartridge is mounted is first described, and the sealing structure of a toner containing portion is then described.

(Entire construction)

Figure 1:
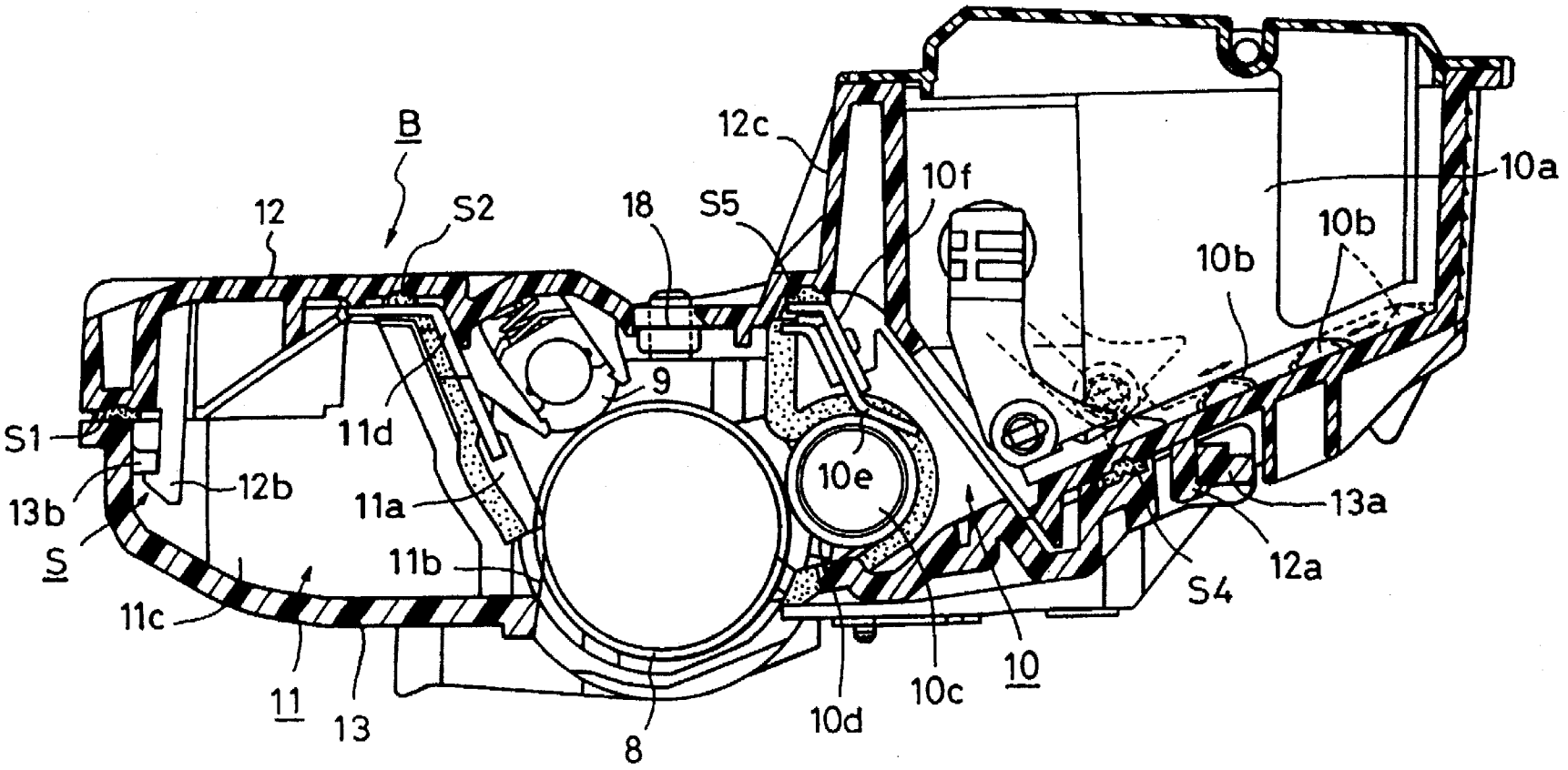
FIG. 1 is a drawing illustrating the construction of a process cartridge of the present invention.
Figure 2:
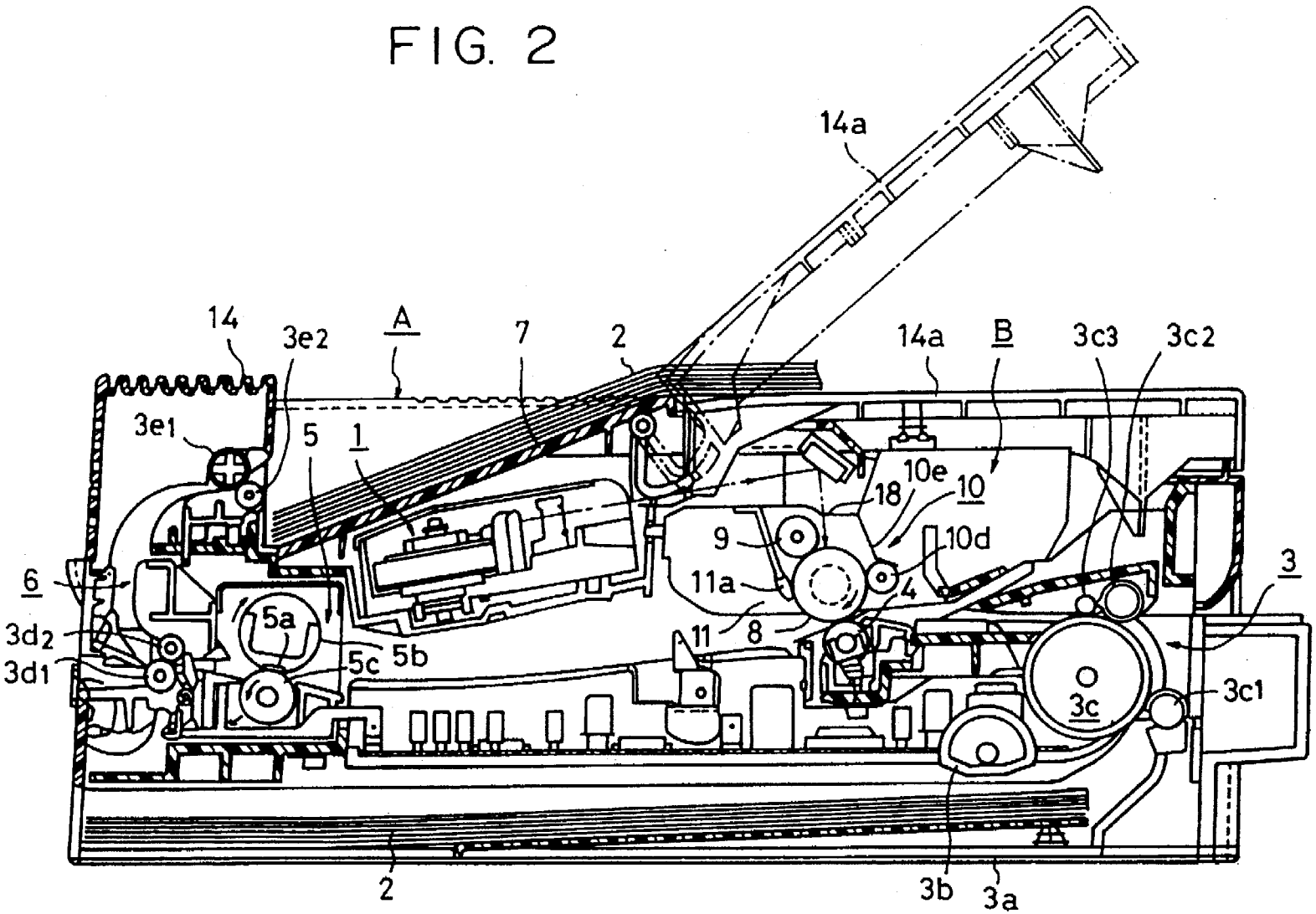
FIG. 2 is a drawing illustrating the construction of an image forming apparatus to which a process cartridge is mounted.
Figure 3:
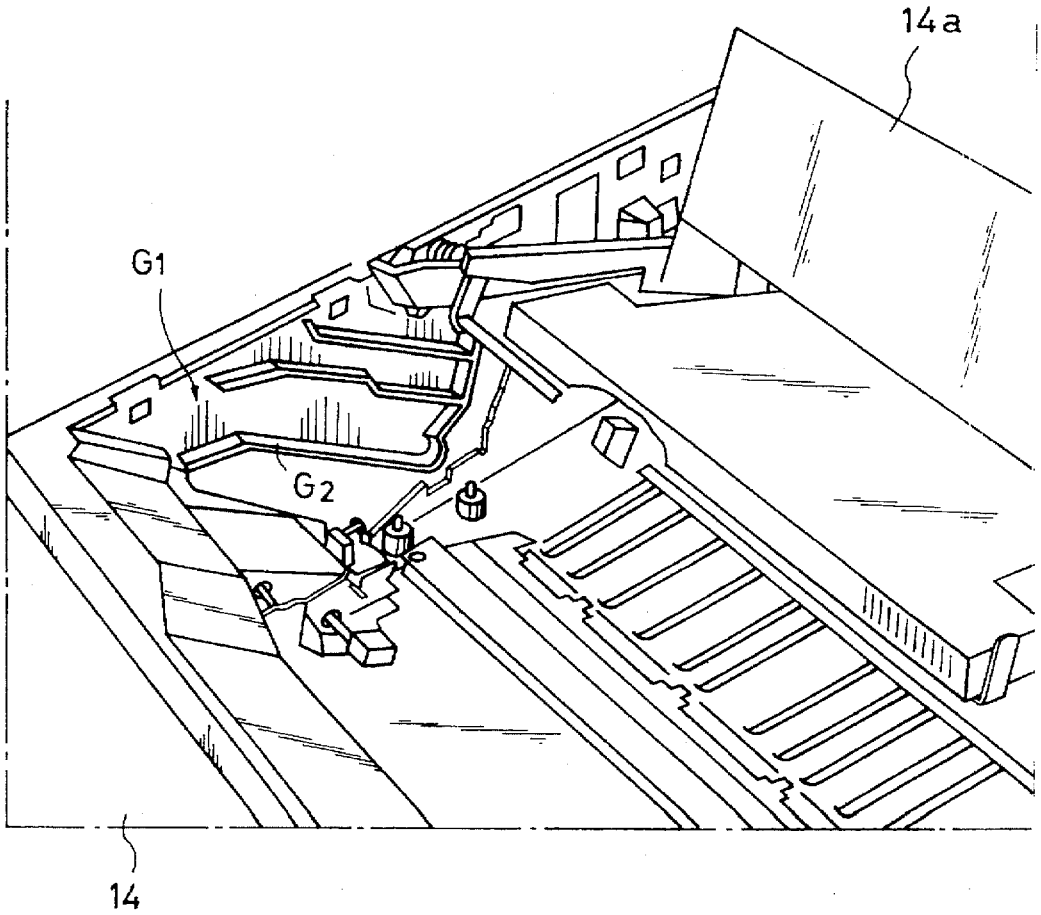
FIG. 3 is a drawing illustrating the construction of a mounting portion of a process cartridge.

FIG. 1 is a drawing illustrating the construction of a process cartridge, FIG. 2 is a drawing illustrating the construction of an image forming apparatus to which a process cartridge is mounted, and FIG. 3 is a drawing illustrating the construction of a mounting portion of a process cartridge.

In image forming apparatus A, as shown in FIG. 2, a light image based on image information is applied from an optical system 1 to a photosensitive drum 8 serving as a drum shaped electrophotographic photosensitive member to form a latent image thereon in accordance with the image information. The latent image is developed by development means 10 to form a toner image. The photosensitive drum 8 is charged by charging means 9 before image exposure. A recording medium 2 is conveyed from a cassette 3*a* by conveyance means 3 comprising a pickup roller 3*b*, a reversal roller 3*c* and pinch rollers 3*c*1 and 3*c*2, both of which are rotated by following the reversal roller 3*c* in pressure contact therewith, synchronously with the formation of the toner image. The toner image is transferred to the recording medium 2 by applying a voltage to a transfer roller 4 serving as transfer means. The recording medium 2 to which the toner image is transferred is then moved to fixing means 5 comprising a fixing rotating member 5b containing a heater 5a, and a driving roller 5c for conveying the recording medium 2 while pressing the recording medium 2 on the rotating member 5b to fix the transferred toner image to the recording medium 2. The recording medium 2 is conveyed by a pair of delivery rollers 3d1 and 3d2, and a pair of delivery rollers 3e1 and 3e2 and delivered to a delivery portion 7 through a reverse conveyance passage 6

On the other hand, in process cartridge B which forms the image forming portion, as shown in FIG. 1, the photosensitive drum 8 having a photosensitive layer is rotated, and the surface thereof is uniformly charged by applying a voltage to the charging roller 9 serving as charging means. As described above, the light image output from the optical system 1 is exposed onto the photosensitive drum 8 through an exposure opening 18 to form a latent image which is then developed by the development means 10. In the development means 10, the toner contained in the toner containing portion 10a is fed by a toner feeding member 10b, and a development roller 10d containing a fixed magnet 10c is rotated, as well as a toner layer to which frictional charge is applied by a development blade 10e being formed on the surface of the development roller 10d. The toner is transferred to the photosensitive drum 8 in accordance with the latent image to form a visible toner image.

After the toner image is transferred to the recording medium 2 by applying a voltage with a polarity opposite to the toner image to the transfer roller 4, the toner remaining on the photosensitive drum 8 is removed by cleaning means 11 comprising a cleaning blade 11a for scraping off the remaining toner, a scoop sheet 11b for scooping the removed toner and a waste toner containing portion 11c for collecting the waste toner.

The parts such as the photosensitive drum 8 and so on are contained in a housing comprising an upper frame 12 and a lower frame 13 to form a cartridge which is detachably mounted to cartridge mounting means provided on the body 14 of the apparatus.

The cartridge mounting means is provided with a cartridge mounting space, as shown in FIG. 2 illustrating an open state of an opening and closing member 14a. The cartridge mounting means comprises cartridge mounting guide members G1 provided on the insides of the left and right sides of the apparatus body 14, and guide portions G2 respectively provided opposite to the left and right guide members G1 so as to insert process cartridge B into the apparatus. (See FIG. 3) When process cartridge B is inserted along the guide portions G2, and when the opening and closing member 14a is closed, process cartridge B is attached to image forming apparatus A.

(Sealing structure of toner containing portion)

Figure 4:
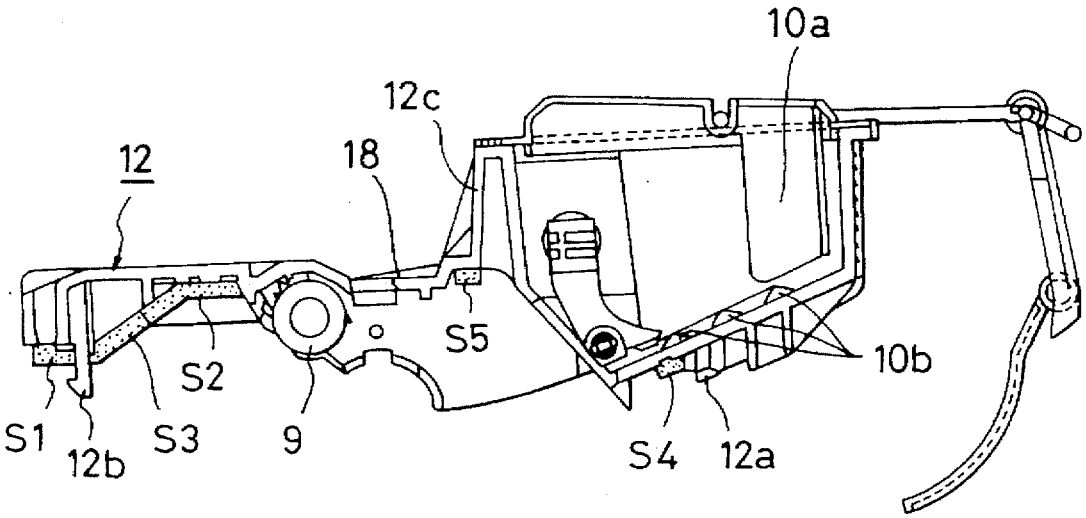
FIG. 4 is a drawing illustrating a state in which upper and lower frames of a process cartridge are separated.
Figure 4:
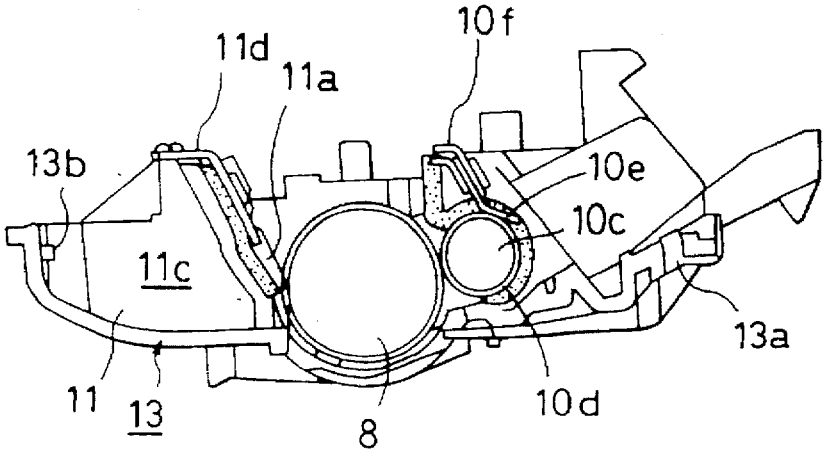
Figure 5:
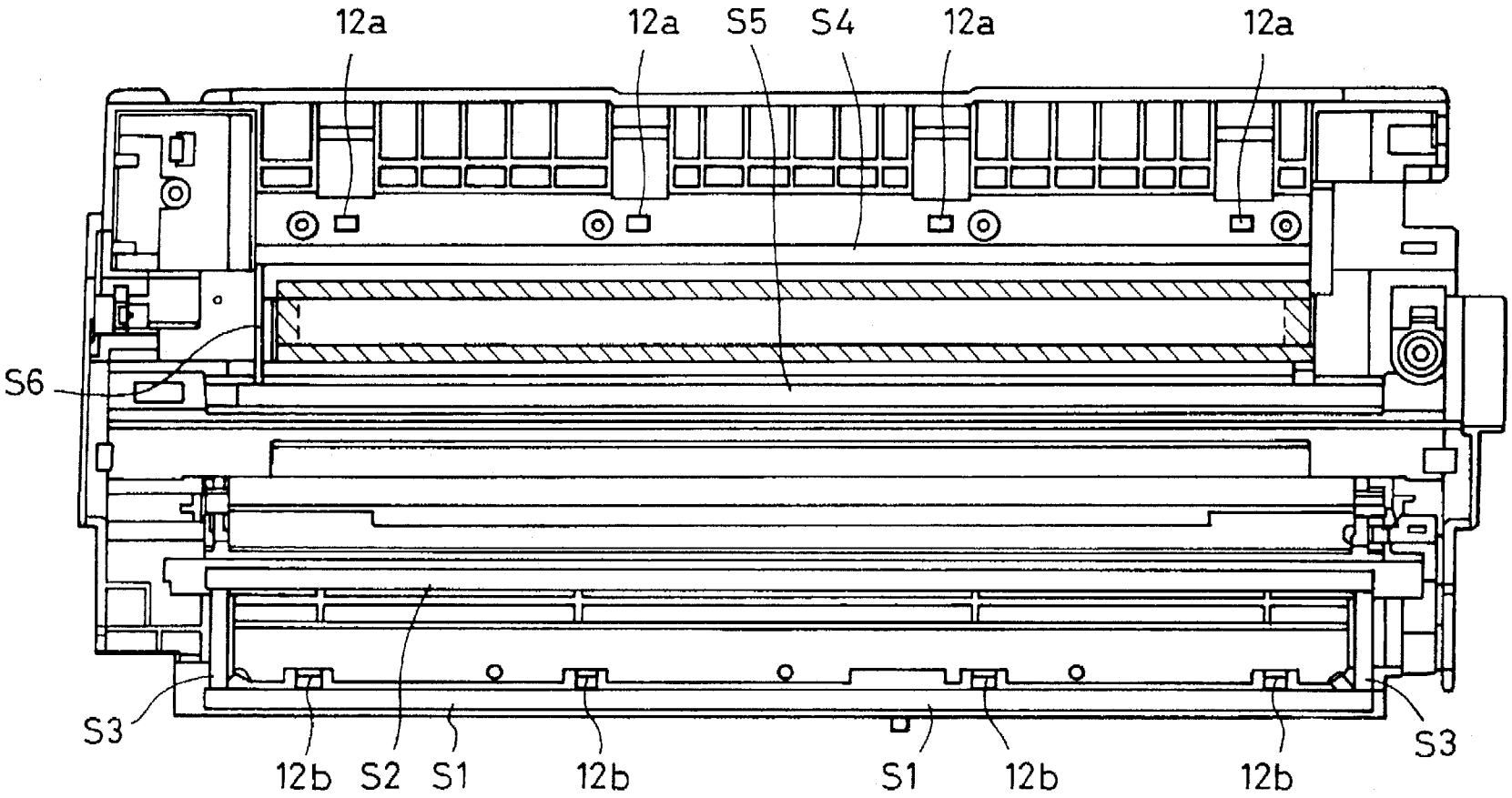
FIG. 5 is a drawing illustrating a sealing structure of an upper frame.
Figure 6:
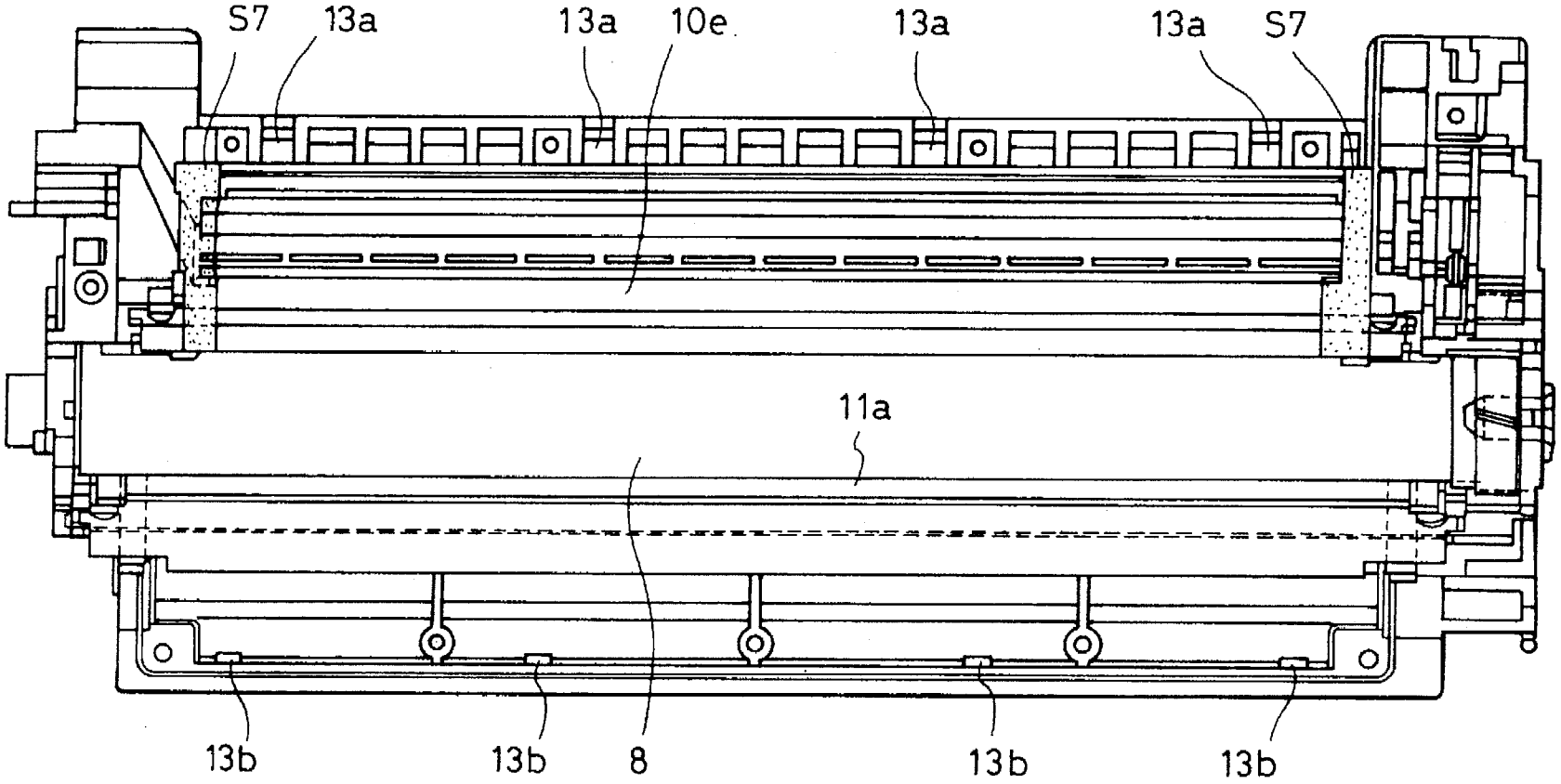
FIG. 6 is a drawing illustrating a sealing structure of a lower frame.

The sealing structure for sealing the joint surfaces of the upper and lower frames 12 and 13 is described below. As described above, the upper and lower frames 12 and 13 can be separated vertically, and combined by elastic engagement between engaging claws 12a and 12b provided on the upper frame 12 and engaging projections 13a and 13b provided on the lower frame 13 corresponding to the engaging claws 12a and 12b, respectively, as shown in FIG. 4. In the present embodiment, a plurality (e.g., four) of engaging claws 12a and 12b and respectively plurality of engaging projections 13a and 13b are provided at substantially equal intervals in the lengthwise direction of the cartridge, as shown in FIGS. 5 and 6.

Sealing members are attached to each of the joint surfaces of the upper and lower frames 12 and 13 so as to prevent leakage of the toner. Sealing members S1, S2 and S3 are applied to the upper frame 12 so as to surround the periphery of the upper surface of the waste toner containing portion 11c, and sealing members S4, S5 and S6 are applied thereto so as to surround the periphery of the upper surface of the toner containing portion 10a, as shown in FIG. 5. Sealing members S7 are applied to the lower frame 13 at both sides of the toner containing portion 10a in the lengthwise direction thereof, as shown in FIG. 6. Each of the sealing members S1 to S7 comprises an elastomer consisting of an urethane foam, such as Moltplane (trade name). The sealing members are respectively applied to the joint surfaces of the upper and lower frames 12 and 13, and then compressed when the upper and lower frames 12 and 13 are bonded to prevent leakage of toner from the toner containing portion 10a and the waste toner containing portion 11c.

When the upper and lower frames 12 and 13 are bonded by elastically engaging the engaging claws 12a and 12b and the engaging projections 13a and 13b, respectively, and when the sealing members are compressed, the frames 12 and 13 are deformed due to the reaction force of the sealing members with the passage of time, thereby causing nonuniform compression of the sealing members and the possibility of deteriorating the sealing properties.

In this embodiment, as shown in FIG. 1, the sealing members S1 and S4 are provided near the portions C of engagement (the engaging claws 12a, 12b and the engaging projections 13a, 13b) between the upper and lower frames 12 and 13, and the engagement portions C are provided at four positions at equal intervals on each of the upper and lower frames 12 and 13. Even if the reaction forces of the sealing members S1 and S4 are applied, therefore, the upper and lower frames 12 and 13 are not easily deformed. The sealing member S5 has rigidity sufficient to resist deformation because a vertical wall 12c is provided on the side of the upper frame 12, and a blade supporting member 10f formed by bending a metal plate in an angular form is provided on the side of the lower frame 13. The sealing members S3, S6 and S7 are short and positioned near the respective sides of the upper and lower frames 12 and 13 and the engagement portions C at both sides thereof, the upper and lower frames 12 and 13 are not easily deformed by the sealing members S3, S6 and S7.

However, the sealing member S2 has sufficient rigidity on the side of the lower frame 13 because it is supported by the cleaning blade supporting member 11d made of a metal, but it is supported by a flat surface of the upper frame 12 without a rib or the like for preventing deformation on the outside of the upper frame 12. Thus, the portions of the upper and lower frames 12 and 13 where the sealing member S2 is applied are easily deformed by the reaction force of the sealing member S2 deformed by compression. This deformation increases in the direction away from the engagement portions C, thereby causing nonuniform compression of the sealing member S2.

Figure 7A:
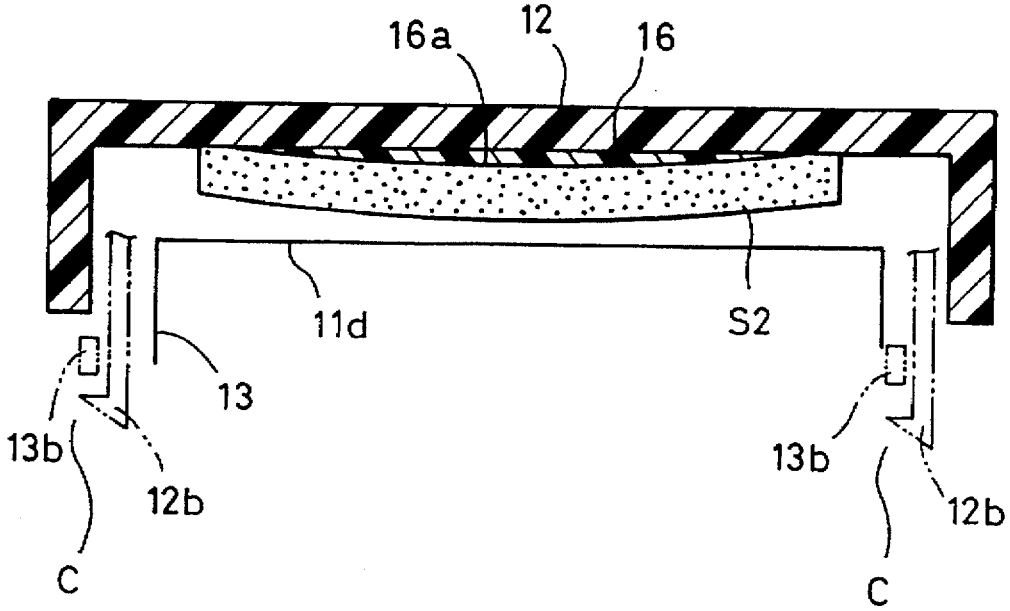
FIGS. 7(*a*) and 7(*b*) are drawings illustrating another embodiment in which a rib is provided on an upper frame.
Figure 7B:
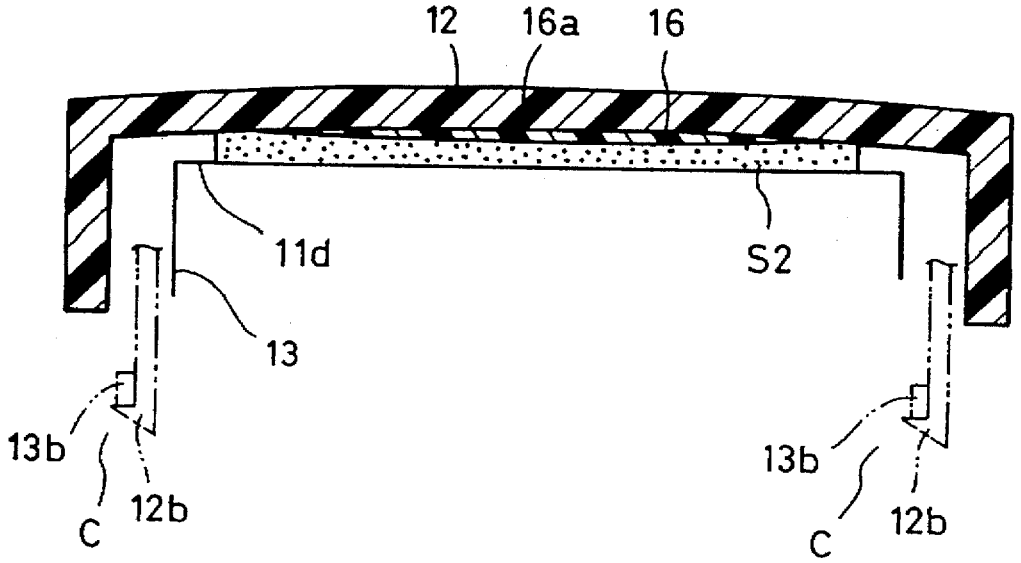

In this embodiment, therefore, a rib 16 having a height which curvedly changes is provided on the mounting seat for the sealing member S2 so that the space between the joint surfaces of the upper and lower frames 12 and 13 decreases in the direction away from the engagement portions C before the upper and lower frames 12 and 13 are bonded, i.e., decreases in accordance with the amount of deformation of the upper frame 12. As shown in FIG. 7(*a*), the central portion of the sealing member S2 is slightly projected before the upper and lower frames 12 and 13 are combined. The rib 16 has a convex surface 16a opposing to the lower frame 13 so that the compression amount of the sealing member S2 increases in the direction away from the respective engagement portions C.

When the upper and lower frames 12 and 13 are combined, as shown in FIG. 7(*b*), the deformation of the upper frame 12 is corrected by the rib 16, and thus the sealing member S2 is uniformly compressed over the whole surface of the lower frame 13. As a result, there is no possibility for toner to leak from these joint portions between the upper and lower frames 12 and 13 for a long period of time, thereby permitting the formation of a clear image by using process cartridge B. The upper and lower frames 12 and 13 are made of a plastic material such as polystyrene, ABS resin (acrylonitrile/butadiene/styrene copolymer), polycarbonate, polyethylene, polypropylene or the like.

Figure 8A:
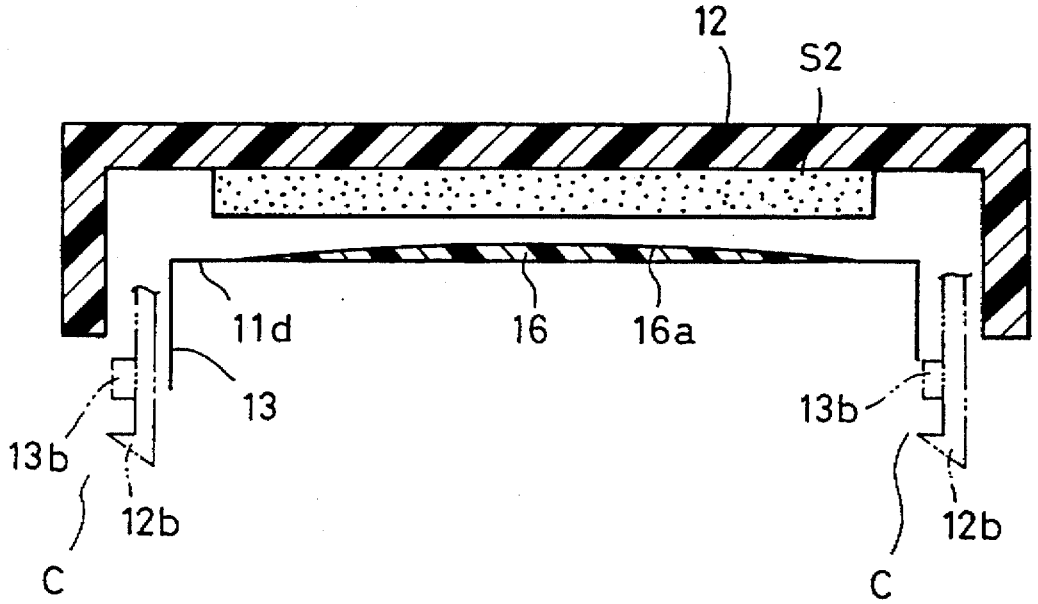
FIGS. 8(*a*) and 8(*b*) are drawings illustrating a further embodiment in which a rib is provided on a lower frame.
Figure 8B:
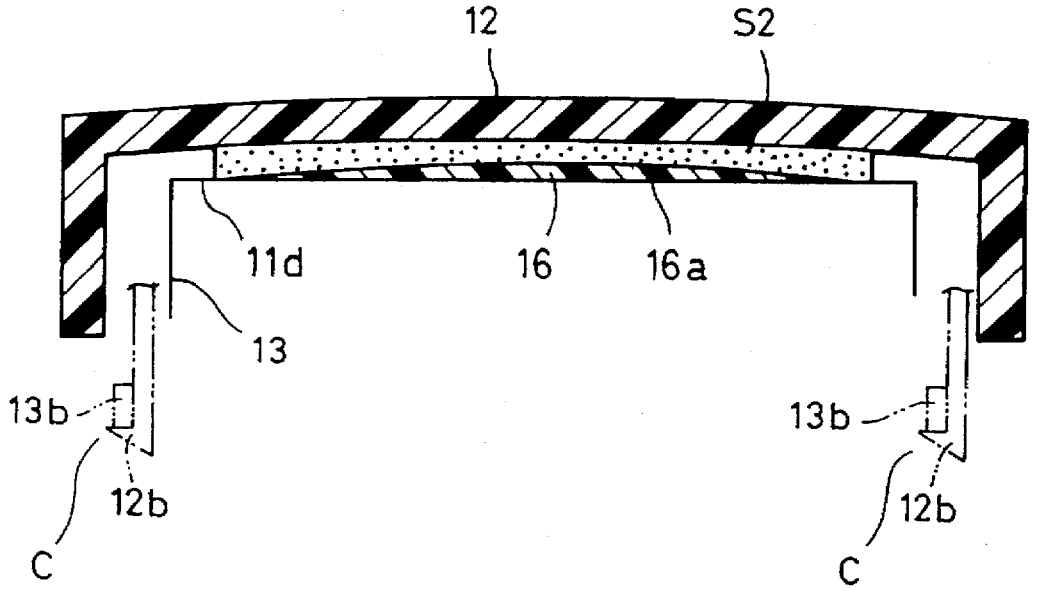

Although, in this embodiment, the rib 16 is provided on the seat face of the upper frame 12 to which the sealing member S2 is attached, when the same rib 16 as that shown in FIGS. 7(*a*) and (*b*) is provided on the lower frame 13 in pressure contact with the sealing member S2, as shown in FIGS. 8(*a*) and (*b*), the same effect as described above can be obtained.

[Second Embodiment]

Figure 9A:
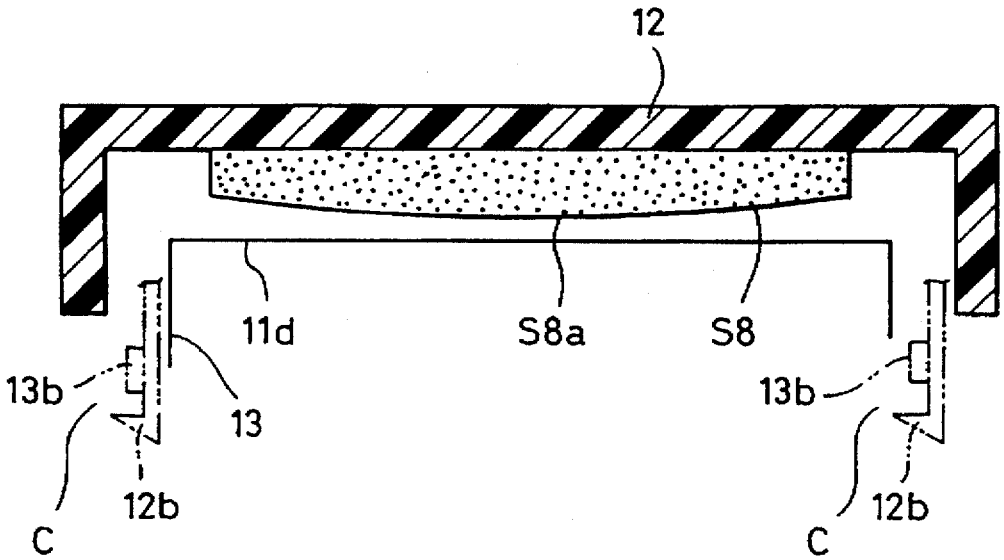
FIGS. 9(*a*) and 9(*b*) are drawings illustrating an embodiment in which the thickness of a sealing member is changed.
Figure 9B:
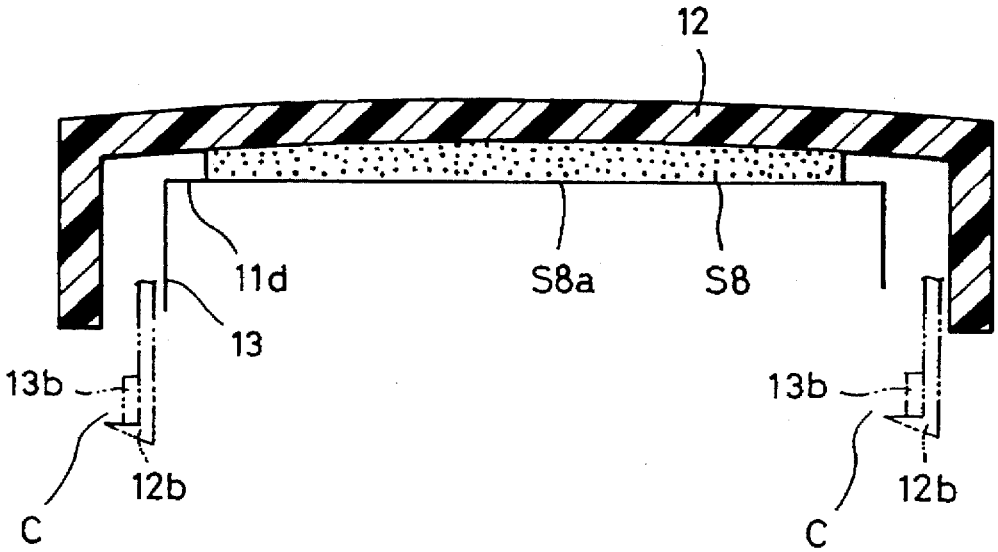

In the first embodiment, the rib 16 is provided for adjusting the space between the upper and lower frames 12 and 13, and the sealing member used has a constant thickness. However, as shown in FIG. 9(*a*), a sealing member S8 having a thickness which changes according to deformation of the upper frame 12 may be used. When the sealing member S8 is attached to the upper frame 12, the space between the lower frame 13 and a deformed portion of the upper frame 12 is small, and the sealing member S8 is substantially uniformly compressed and bonded to the blade supporting member 11*d* mounted on the lower frame 13 thereacross when the upper and lower frames 12 and 13 are combined, as shown in FIG. 9(*b*). Even if a sealing member S8 which changes in thickness is used in place of the use of the rib 16, the same effect as described above can be obtained. The sealing member S8 has a convex surface S8*a* opposing the lower frame 13 so that the compression of the sealing member S8 increases in the direction away from the respective engagement portions C.

Although in the present embodiment the sealing member is made of a polyurethane foam, for example, a sealing member which is formed by injecting liquid elastomer and solidifying it may be used. Since such an injected sealing member generally forms, on the surface layer thereof, a so-called skin layer containing substantially no bubble, the sealing effect is increased, but the elastic reaction force is higher than with urethane foam. As described above, therefore, the construction of the rib is or the thickness of the sealing member may be changed in accordance with the deformation of the upper frame 12 or the lower frame 13 to effectively increase the reliability of prevention of leakage of the toner, which is caused by the reaction force of the sealing member.

Figure 10A:
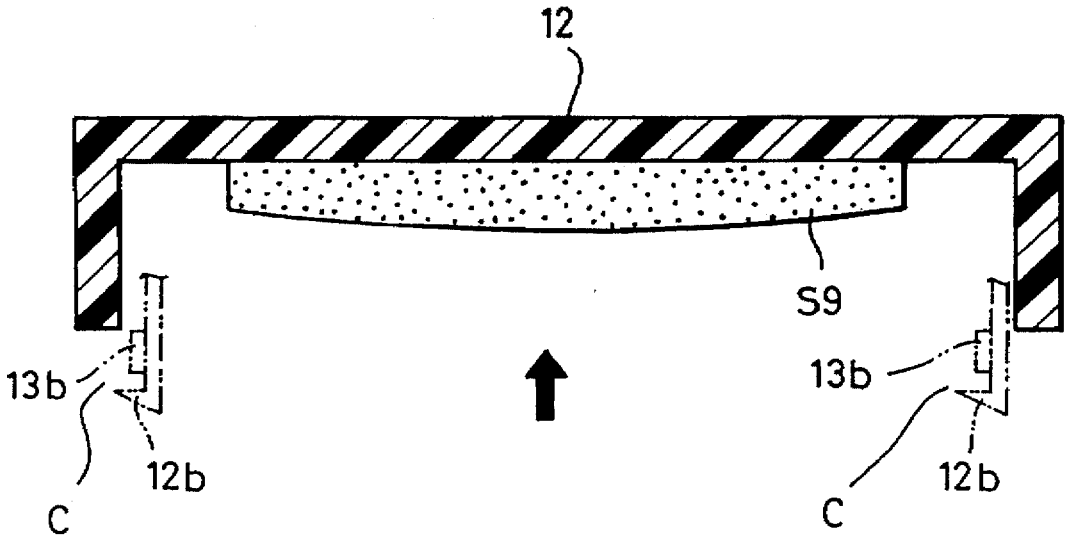
FIGS. 10(*a*) and 10(*b*) are drawings illustrating a sealing member comprising a liquid elastomer.
Figure 10B:
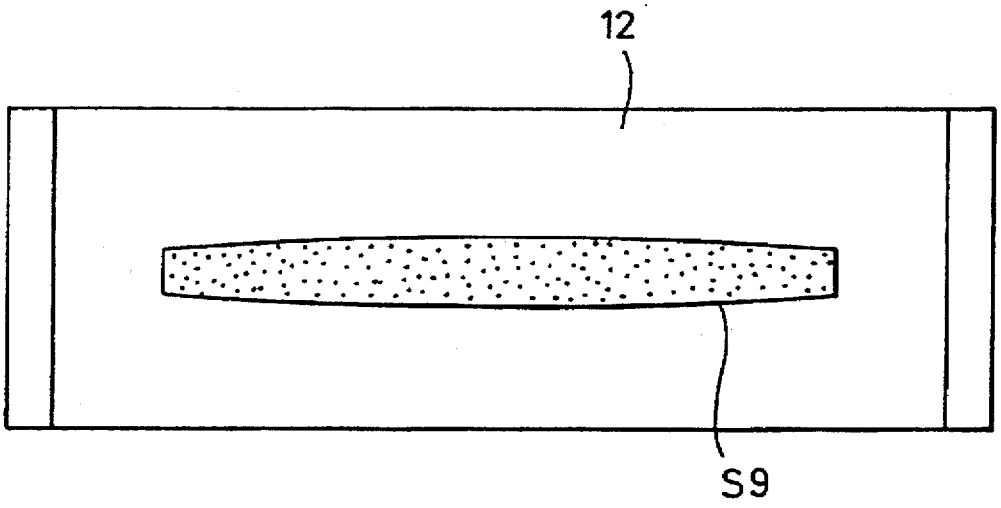

Methods of changing the thickness of the injected sealing member include a method of changing the discharge amount of the liquid elastomer with a constant relative speed between an injection nozzle and a frame into which the elastomer is injected, and a method of changing the relative speed with a constant discharge amount of the liquid elastomer. FIG. 10(*a*) is a sectional view of the injected sealing member S9, and FIG. 10(*b*) is a plan view as seen from the arrow shown in FIG. 10(*a*). In both aspects, the central portion of the sealing member S9 is thick.

[Other embodiments]

Although, in the above embodiments, the rib 16 is provided or the thickness of a sealing member is changed so that the space between the joint surfaces curvedly changes before bonding, the space may be changed not only curvedly but also linearly or stepwisely. In this case, the same effect can be obtained.

Although, in the above embodiments, the space between the joint surfaces for sealing the waste toner containing portion 11*c* is changed, such joint surfaces are not limited to the joint surfaces of the waste toner containing portion 11*c*, and joint surfaces for sealing the toner containing portion 10*a* of the development means 10 can also be constructed in the same manner as described above. This can securely prevent leakage of the toner from the toner containing portion or the waste toner containing portion.

Each of the above embodiments relates to a process cartridge which comprises an electrophotographic photosensitive member 8 and process means for acting on the electrophotographic photosensitive member 8, and which is detachably mountable to a body of an image forming apparatus. The process cartridge further comprises the upper frame 12, the lower frame 13, and the elastic sealing member S8 (S9) which is interposed between the upper and lower frames 12 and 13 in order to prevent leakage of the toner from joint portions therebetween when both frames 12 and 13 are bonded by engaging the engagement portions C. In this process cartridge, the compression amount of the elastic sealing member S8 (S9) interposed between both frames is increased in the direction away from the engagement portions C. The thickness of the elastic sealing member S8 (S9) interposed between both frames 12 and 13 is increased in the direction away from the engagement portions C (refer to FIGS. 8 and 9). Although, in the embodiment shown in FIGS. 9 and 10, the thickness of the elastic sealing member S8 (S9) is curvedly changed, the thickness of the sealing member may be changed linearly or stepwisely. The upper and lower frames 12 and 13 have a toner containing portion for containing toner used for developing the latent image formed on the electrophotographic photosensitive member 8, and the elastic sealing member is adapted for preventing leakage of the toner from the toner containing portion. Alternatively, the upper frame 12 and the lower frame 13 have the removed toner containing portion 11*c* for containing toner removed from the electrophotographic photosensitive member, the elastic sealing member being adapted for preventing leakage of the toner from the removed toner containing portion. In another embodiment, the elastic sealing member S2 is interposed between the upper and lower frames 12 and 13 so that when both frames are bonded, the space between the joint surfaces thereof decreases in the direction away from the engagement portions C. Although the opposite joint surfaces of the upper frame 12 and/or the lower frame 13 are curvedly changed so that the space between the joint surfaces is decreased (refer to FIGS. 7 and 8), the joint surfaces may be changed linearly or stepwisely.

Process cartridge B of the present invention can preferably be applied not only to the case in which a single color image is formed, as described above, but also to a cartridge for forming an image of a plurality of colors (for example, a two-color image, a three-color image or a full-color image) by using a plurality of respective development means.

As the development method, various known methods such as a two-component magnetic brush development method, a cascade development method, a touch down development method, a cloud method, etc. can be used.

The electrophotographic photosensitive member is not limited to the above photosensitive drum, and, for example, the following bodies can also be used. A photosensitive member including material such as amorphous silicon, amorphous selenium, zinc oxide, titanium oxide or an organic photoconductor (OPC) is used as a photosensitive material. Although members on which the photosensitive material is loaded include a rotating member having the form of a drum, a belt or the like, and a sheet, a drum- or belt-formed member is generally used. For example, a drum type photosensitive member is formed by depositing or coating a photoconductor on a cylinder made of an aluminum alloy or the like.

Although the first embodiment uses charging means which employs a so-called contact charge method, another conventionally known method can of course be used in which metallic shields made of aluminum or the like are arranged in three directions around a tungsten wire, and positive or negative ions produced by applying a high voltage to the tungsten wire are moved to the surface of a photosensitive drum to uniformly charge the surface of the drum.

Besides the roller type charging means, a blade type (charging blade), a pad type, a block type, a rod type or a wire type charging means may be used.

The means for cleaning off the toner remaining on the photosensitive drum may comprise a blade, a fur brush, a magnetic brush or the like.

The above process cartridge comprises the electrophotographic photosensitive member and at least one process means. Examples of process cartridges other than that in the above embodiments include a cartridge comprising an electrophotographic photosensitive member and charging means, which are integrally provided so that the cartridge is detachably mountable to a body of an apparatus, a cartridge comprising an electrophotographic photosensitive member and development means which are integrally provided so that the cartridge is detachably mountable to a body of an apparatus, a cartridge comprising an electrophotographic photosensitive member and cleaning means which are integrally provided so that the cartridge is detachably mountable to a body of an apparatus, and a cartridge comprising an electrophotographic photosensitive member and a combination of at least two process means, which are integrally provided so that the cartridge is detachably mountable to a body of an apparatus.

Namely, the process cartridge is a cartridge comprising charging means, development means or cleaning means and an electrophotographic photosensitive member, which are integrated so that the cartridge is detachably mountable to a body of an image forming apparatus, a cartridge comprising at least one of charging means, development means and cleaning means and an electrophotographic photosensitive member, which are integrated so that the cartridge is detachably mountable to a body of an image forming apparatus, or a cartridge comprising at least development means and an electrophotographic photosensitive member, which are integrated so that the cartridge is detachably mountable to a body of an image forming apparatus, Although, in the above embodiments, a laser beam printer is exemplified as an image forming apparatus, the present invention is not limited to this. For example, the present invention can of course be applied to other image forming apparatus such as an electrophotographic copying machine, a facsimile apparatus, a word processor, etc.

As described above, the space between the joint surfaces with a sealing member interposed therebetween is decreased in the direction away from the engagement portions which are easily warped due to the reaction force of the elastic sealing member. Thus the sealing member is uniformly compressed and bonded thereacross, thereby increasing the reliability of prevention of leakage of toner from the portion for containing the toner. An image formation process the above-described process cartridge can thus form a clear image.

Even when the cartridge is stored for a long period of time, the above embodiments can prevent the toner from leaking from the space between the joint surfaces of a sealing member and a frame, which space is formed by gradual increase in the warping amount of the frame. This is because, in each of the above embodiments, even if the frame is warped, the compression amount of the sealing member decreases in accordance with the warping, thereby assuring contact between the sealing member and the joint surface of the frame. Even if the frame is warped, no space occurs between the sealing member and the joint surface of the frame.

As described above, the present invention can provide a process cartridge and an image forming apparatus which produce no leakage of toner even if a frame is warped.

What is claimed is:

1. A process cartridge detachably mountable to a main body of an image forming apparatus, said process cartridge comprising:

an electrophotographic photosensitive member;

process means for acting on said electrophotographic photosensitive member;

a first frame;

a second frame; and an elastic sealing member, having a longitudinal center, interposed between said first frame and said second frame to prevent leakage of toner through a space therebetween when said first frame and said second frame are bonded by engagement between first and second engagement portions, wherein a compression amount of said elastic sealing member interposed between said first frame and said second frame increases in directions away from said first and second engagement portions toward the longitudinal center of said elastic sealing member.

2. A process cartridge according to claim 1, wherein the thickness of said elastic sealing member interposed between said first frame and said second frame increases in the directions away from said first and second engagement portions.

3. A process cartridge according to claim 2, wherein the thickness of said elastic sealing member changes linearly, curvedly or stepwisely.

4. A process cartridge according to claim 1, wherein said first frame and said second frame form a toner containing portion for containing toner used for developing a latent image formed on said electrophotographic photosensitive member, and said elastic sealing member is adapted for preventing leakage of toner from said toner containing portion.

5. A process cartridge according to claim 1, wherein said first frame and said second frame form a removed toner containing portion for containing toner removed from said electrophotographic photosensitive member, and said elastic sealing member is adapted for preventing leakage of toner from said removed toner containing portion.

6. A process cartridge according to any one of claims 1, 2 and 3, wherein said elastic sealing member is made of a urethane foam.

7. A process cartridge according to any one of claims 1, 2 and 3, wherein said elastic sealing member is formed by an injected liquid elastomer.

8. A process cartridge according to any one of claims 1, 2 and 3, wherein said elastic sealing member has a skin layer containing no bubbles in the surface layer thereof in a foamed state containing bubbles therein.

9. A process cartridge according to claim 1, wherein a space between joint surfaces of said first frame and said second frame decreases in the directions away from said first and second engagement portions when said first frame and said second frame are bonded with said elastic sealing member therebetween.

10. A process cartridge according to claim 9, wherein opposing joint surfaces of said first frame and/or said second frame are changed linearly, curvedly or stepwisely so that the space between the joint surfaces is decreased.

11. A process cartridge according to any one of claims 1, 9 and 10, wherein said first frame and said second frame are made of plastic.

12. A process cartridge according to claim 11, wherein said plastic is polystyrene, an ABS resin (acrylonitrile/butadiene/styrene copolymer), polycarbonate, polyester or polypropylene.

13. A process cartridge according to claim 1, wherein said process cartridge further comprises charging means, development means or cleaning means as said process means and said electrophotographic photosensitive member which are integrally formed so that said cartridge is detachably mountable to a main body of an image forming apparatus.

14. A process cartridge according to claim 1, wherein said process cartridge further comprises at least one of charging means, development means and cleaning means as said process means and said electrophotographic photosensitive member which are integrally formed so that said cartridge is detachably mountable to a main body of an image forming apparatus.

15. A process cartridge according to claim 1, wherein said process cartridge further comprises at least development means as said process means and said electrophotographic photosensitive member which are integrally formed so that said cartridge is detachably mountable to a main body of an image forming apparatus.

16. An image forming apparatus, for forming an image on a recording medium, to which a process cartridge is detachably mountable, said image forming apparatus comprising:

(a) mounting means for removably mounting a process cartridge including:

an electrophotographic photosensitive member;

process means for acting on said electrophotographic photosensitive member;

a first frame;

a second frame; and an elastic sealing member, having a longitudinal center, interposed between said first frame and said second frame to prevent leakage of toner from a space therebetween when said first frame and said second frame are bonded by engagement between first and second engagement portions, a compression amount of said elastic sealing member interposed between said first frame and said second frame increasing in directions away from said first and second engagement portions toward the longitudinal center of said elastic sealing member; and (b) conveyance means for conveying the recording medium.

17. A process cartridge detachably mountable to a main body of an image forming apparatus, said process cartridge comprising:

an electrophotographic photosensitive member;

process means for acting on said electrophotographic photosensitive member;

a first frame;

a second frame;

a rib formed on one of said first frame and said second frame and extending toward the other of said first frame and said second frame when said first frame and said second frame are bonded by engagement between first and second engagement portions, wherein a maximum amount of extension of said rib toward the other of said first frame and said second frame occurs at a longitudinal center of said rib; and an elastic sealing member, having a longitudinal center, interposed between said first frame and said second frame, and aligned with said rib, to prevent leakage of toner through a space therebetween when said first frame and said second frame are bonded by engagement between the first and second engagement portions, wherein a compression amount of said elastic sealing member interposed between said first frame and said second frame increases in directions away from said first and second engagement portions toward the longitudinal center of said rib.

18. A process cartridge according to claim 17, wherein said first frame and said second frame form a toner containing portion for containing toner used for developing a latent image formed on said electrophotographic photosensitive member, and said elastic sealing member is adapted for preventing leakage of toner from said toner containing portion.

19. A process cartridge according to claim 17, wherein said first frame and said second frame form a removed toner containing portion for containing toner removed from said electrophotographic photosensitive member, and said elastic sealing member is adapted for preventing leakage of toner from said removed toner containing portion.

20. A process cartridge according to claim 17, wherein said elastic sealing member is made of a urethane foam.

21. A process cartridge according to claim 17, wherein said elastic sealing member is formed by an injected liquid elastomer.

22. A process cartridge according to claim 17, wherein said elastic sealing member has a skin layer containing no bubbles in the surface layer thereof in a foamed state containing bubbles therein.

23. A process cartridge according to claim 17, wherein said first frame and said second frame are made of plastic.

24. A process cartridge according to claim 23, wherein said plastic is polystyrene, an ABS resin (acrylonitrile/butadiene/styrene copolymer), polycarbonate, polyester or polypropylene.

25. A process cartridge according to claim 17, wherein said process cartridge further comprises charging means, development means or cleaning means as said process means and said electrophotographic photosensitive member which are integrally formed so that said cartridge is detachably mountable to a main body of an image forming apparatus.

26. A process cartridge according to claim 17, wherein said process cartridge further comprises at least one of charging means, development means and cleaning means as said process means and said electrophotographic photosensitive member which are integrally formed so that said cartridge is detachably mountable to a main body of an image forming apparatus.

27. A process cartridge according to claim 17, wherein said process cartridge further comprises at least development means as said process means and said electrophotographic photosensitive member which are integrally formed so that said cartridge is detachably mountable to a main body of an image forming apparatus.

28. A process cartridge detachably mountable to a main body of an image forming apparatus, said process cartridge comprising:

an electrophotographic photosensitive member;

process means for acting on said electrophotographic photosensitive member;

a first frame;

a second frame; and an elastic sealing member, having a longitudinal center and having a variable thickness that is a maximum at the longitudinal center in a non-compressed state, interposed between said first frame and said second frame to prevent leakage of toner through a space therebetween when said first frame and said second frame are bonded by engagement between first and second engagement portions, wherein a compression amount of said elastic sealing member interposed between said first frame and said second frame increases in directions away from said first and second engagement portions toward the longitudinal center of said elastic sealing member.

29. A process cartridge according to claim 28, wherein the thickness of said elastic sealing member changes linearly, curvedly or stepwisely.

30. A process cartridge according to claim 28 or 29, wherein said elastic sealing member is made of a urethane foam.

31. A process cartridge according to claim 28 or 29, wherein said elastic sealing member is formed by an injected liquid elastomer.

32. A process cartridge according to claim 28 or 29, wherein said elastic sealing member has a skin layer containing no bubbles in the surface layer thereof in a foamed state containing bubbles therein.

33. A process cartridge according to claim 28, wherein said first frame and said second frame form a toner containing portion for containing toner used for developing a latent image formed on said electrophotographic photosensitive member, and said elastic sealing member is adapted for preventing leakage of toner from said toner containing portion.

34. A process cartridge according to claim 28, wherein said first frame and said second frame form a removed toner containing portion for containing toner removed from said electrophotographic photosensitive member, and said elastic sealing member is adapted for preventing leakage of toner from said removed toner containing portion.

35. A process cartridge according to claim 28, wherein said first frame and said second frame are made of plastic.

36. A process cartridge according to claim 35, wherein said plastic is polystyrene, an ABS resin (acrylonitrile/butadiene/styrene copolymer), polycarbonate, polyester or polypropylene.

37. A process cartridge according to claim 28, wherein said process cartridge further comprises charging means, development means or cleaning means as said process means and said electrophotographic photosensitive member which are integrally formed so that said cartridge is detachably mountable to a main body of an image forming apparatus.

38. A process cartridge according to claim 28, wherein said process cartridge further comprises at least one of charging means, development means and cleaning means as said process means and said electrophotographic photosensitive member which are integrally formed so that said cartridge is detachably mountable to a main body of an image forming apparatus.

39. A process cartridge according to claim 28, wherein said process cartridge further comprises at least development means as said process means and said electrophotographic photosensitive member which are integrally formed so that said cartridge is detachably mountable to a main body of an image forming apparatus.

* * * * *

UNITED STATES PATENT AND TRADEMARK OFFICE

CERTIFICATE OF CORRECTION

PATENT NO. : 5,740,499

DATED : April 14, 1998

INVENTOR(S) : AKIRA HIGETA ET AL.

It is certified that error appears in the above-identified patent and that said Letters Patent is hereby corrected as shown below:

COLUMN 1

Line 17, "cartridges" should read --cartridges may--.
Line 21, "In another aspect the" should read --a--.
Line 22, "apparatus; a" should read --apparatus. In another aspect the--.
Line 26, "Cartridge" should read --In yet another aspect, the cartridge--.

COLUMN 3

Line 8, "6" should read --6.--.
Line 61, "respectively" should read --respective--.

COLUMN 4

Line 64, "to" should be deleted.

COLUMN 5

Line 49, "is" should be deleted.

COLUMN 6

Line 67, "including" should read --including a--.

UNITED STATES PATENT AND TRADEMARK OFFICE

CERTIFICATE OF CORRECTION

PATENT NO. : 5,740,499

DATED : April 14, 1998

INVENTOR(S) : AKIRA HIGETA ET AL.

It is certified that error appears in the above-identified patent and that said Letters Patent is hereby corrected as shown below:

COLUMN 7

Line 55, "apparatus," should read --apparatus.--.

COLUMN 8

Line 2, "process" should read --process using--.

Signed and Sealed this

Tenth Day of November 1998

*Attest:*

*Attesting Officer*

BRUCE LEHMAN

*Commissioner of Patents and Trademarks*